US006152261A

United States Patent [19]

Hoey

[11] Patent Number: 6,152,261

[45] Date of Patent: Nov. 28, 2000

[54] SAFETY LADDER ATTACHMENT

[76] Inventor: Dale E. Hoey, 328 Copperfield Dr., Williamstown, N.J. 08094

[21] Appl. No.: 09/318,920

[22] Filed: May 26, 1999

Related U.S. Application Data

[63] Continuation of application No. 08/767,843, Dec. 17, 1996, Pat. No. 5,931,259.

[51] Int. Cl.[7] ..... E04G 5/02

[52] U.S. Cl. ..... 182/107

[58] Field of Search ..... 182/45, 93, 97, 182/107, 108, 111, 129, 172, 206, 214, 229; 248/210

[56] References Cited

U.S. PATENT DOCUMENTS

| | | | |
|---|---|---|---|
| 599,963 | 3/1898 | Hatch . | |
| 3,603,431 | 9/1971 | Nameche | 182/206 |
| 4,078,633 | 3/1978 | Fahy | 182/229 X |
| 4,232,759 | 11/1980 | Jacobs | 182/214 X |
| 4,280,590 | 7/1981 | Polizzi | 182/214 |
| 4,306,632 | 12/1981 | Brown | 182/214 |
| 4,311,207 | 1/1982 | Lurry | 182/214 X |
| 4,502,566 | 3/1985 | Wing | 182/214 |
| 4,723,632 | 2/1988 | Gedgoudas et al. | 182/214 |
| 4,787,478 | 11/1988 | Stakes | 182/107 X |
| 4,949,810 | 8/1990 | Dwinnell | 182/214 |
| 5,012,895 | 5/1991 | Santos | 182/204 |
| 5,121,814 | 6/1992 | Southern | 182/214 |
| 5,165,501 | 11/1992 | Donahey | 182/214 |
| 5,165,641 | 11/1992 | Southern | 248/230 |
| 5,180,032 | 1/1993 | Hidalgo | 182/214 |
| 5,358,071 | 10/1994 | Stennett | 182/107 X |
| 5,373,913 | 12/1994 | Santos | 182/107 |
| 5,423,397 | 6/1995 | Boughner | 182/107 |
| 5,462,133 | 10/1995 | Merrill, Jr. et al. | 182/111 X |
| 5,499,691 | 3/1996 | Fitzpatrick | 182/107 |
| 5,511,632 | 4/1996 | Ermis | 182/107 X |
| 5,551,529 | 9/1996 | Molitor | 182/111 X |

*Primary Examiner*—Alvin Chin-Shue
*Assistant Examiner*—Curtis A. Cohen
*Attorney, Agent, or Firm*—Norman E. Lehrer

[57] ABSTRACT

A safety attachment for a ladder of the type which comprises a pair of spaced apart parallel side rails and a plurality of rungs extending between the side rails. The safety attachment includes a pair of tubular members, each of which is secured to a corresponding one of the side rails of the ladder. Two extension arms are also provided. One end of each of the extension arms has a friction pad secured thereto. The other end of each extension arm is pivotally attached to the top end of a corresponding one of the tubular members.

10 Claims, 3 Drawing Sheets

SAFETY LADDER ATTACHMENT

CROSS-REFERENCE TO RELATED APPLICATIONS

This application is a Continuation of U.S. application Ser. No. 08/767,843 filed Dec. 17, 1996 now U.S. Pat. No. 5,931,259.

BACKGROUND OF THE INVENTION

The present invention is directed toward a safety ladder attachment for assisting a worker while getting on or off a roof and, more particularly, to such an attachment which includes a pair of upper extension arms pivotally secured to opposite sides of a ladder.

Ladders, and extension ladders in particular, are often used to allow a worker to gain access to a roof or the like. In use, the upper section of the ladder is positioned adjacent the edge of the roof. The most dangerous time for a worker occurs when getting off the ladder and onto the roof or when getting back onto the ladder after finishing working on the roof. If the worker does not balance himself correctly he could accidentally cause the ladder to slip and/or fall. Accordingly, the worker could be seriously injured if he loses his balance and falls with the ladder.

In recognition of the foregoing, various attachments have been designed which are secured to the upper section of the ladder in order to prevent the same from sliding when it is placed adjacent the edge of a roof. See, for example, U.S. Pat. Nos. 4,306,632, 4,280,590, 4,949,810, 5,165,501, and 5,180,032. However, none of the devices disclosed in the foregoing patents provides means for helping a worker to maintain his balance when getting on or off the roof.

U.S. Pat. No. 5,012,895 discloses a pair of extension arms which are secured to the side rails of the ladders. A pair of stabilizing bars extend between the extension arms to minimize the possibility of the ladder from slipping. Each of the extension arms includes a handle hoop. When being used to provide a worker with access to a roof, the extension arms on the ladder are positioned to extend past the roof edge. The upper portion of each of the handle hoops, which are adapted to be grasped by the worker, are located a significant distance from the roof. Accordingly, if the worker's hands slip off the handles he could easily lose his balance and fall from the ladder. Further, the handle hoops cannot be readily moved from an operable position to an inoperable position.

SUMMARY OF THE INVENTION

The present invention is designed to overcome the deficiencies of the prior art discussed above. It is an object of this invention to provide a safety ladder attachment which assists a worker while getting on or off an inclined elevated surface such as a roof.

It is a further object of the invention to provide such a ladder attachment that can be readily attached to a conventional ladder.

It is yet another object of the invention to provide a ladder attachment that can be placed in an inoperable position when not in use.

In accordance with the illustrative embodiments, demonstrating features and advantages of the present invention, there is provided a safety attachment for a ladder of the type which comprises a pair of spaced apart parallel side rails and a plurality of rungs extending between the side rails. The safety attachment includes a pair of tubular members, each of which is secured to a corresponding one of the side rails of the ladder. Two extension arms are also provided. An end of each of the extension arms has a friction pad secured thereto. The other end of each extension arm is pivotally attached to the top end of a corresponding one of the tubular members.

BRIEF DESCRIPTION OF THE DRAWINGS

For the purpose of illustrating the invention, there is shown in the accompanying drawings one form which is presently preferred, it being understood that the invention is not intended to be limited to the precise arrangements and instrumentalities shown.

DETAILED DESCRIPTION OF THE PREFERRED EMBODIMENT

Figure 5:
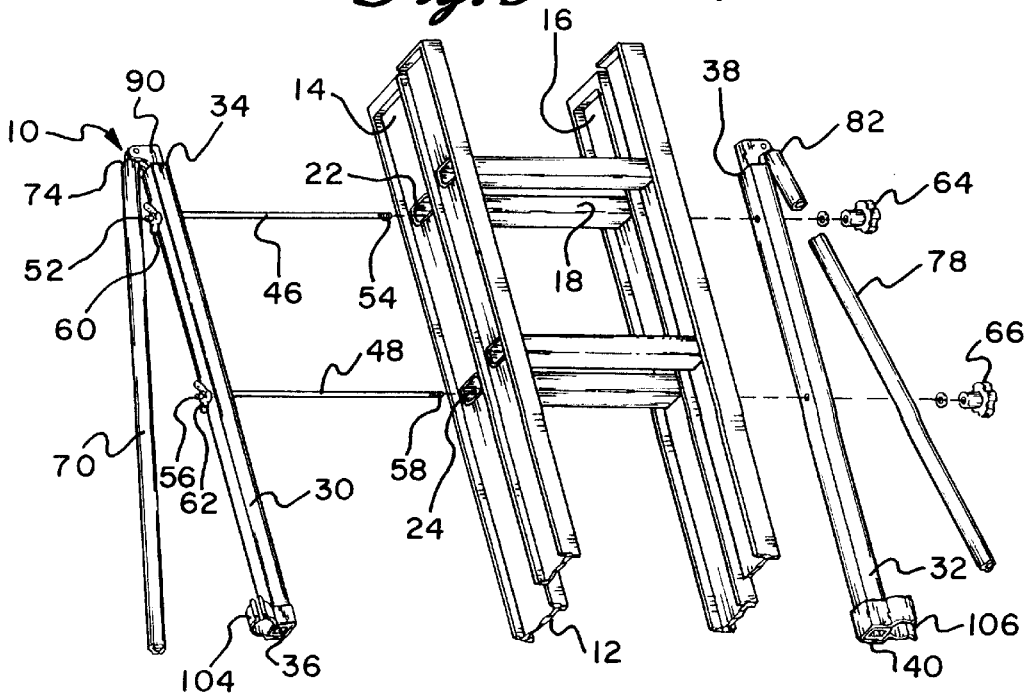
FIG. 5 is a perspective view of the extension arms shown exploded from the ladder.

Referring now to the drawings in detail wherein like reference numerals have been used throughout the various figures to designate like elements, there is shown in FIG. 5 a safety attachment for assisting a worker while getting on or off an inclined elevated surface such as a roof constructed in accordance with the principles of the present invention and designated generally as 10.

The safety attachment 10 is adapted to be secured to a ladder 12 of the type which includes a pair of spaced apart parallel side rails 14 and 16 and a plurality of rungs extending between the side rails. The plurality of rungs includes a top rung 18. Each of the rungs and the side rails of the ladder preferably define a channel 22 (FIG. 5). Each of the side rails 14 and 16 also includes an upper free end 26 and 28, respectively.

The safety attachment 10 includes a pair of tubular members 30 and 32 (FIG. 5). Tubular member 30 has a top end 34 and a bottom end 36. Similarly, tubular member 32 has a top end 38 and a bottom end 40. Each tubular member is secured to a corresponding one of the side rails of the ladder. In the preferred embodiment, each tubular member has an upper pair of holes and a lower pair of holes formed therein. An upper connecting rod 46 having a first threaded end 52 and a second threaded end 54 is provided (FIG. 5). A lower connecting rod 48 having a first threaded end 56 and a second threaded end 58 is also provided.

The upper connecting rod 46 extends through the upper pair of holes in the tubular member 30. The threaded end 52 is secured to the tubular member 30 by means of a wing nut 60. The lower connecting rod 48 extends through the lower pair of holes in the tubular member 30 and its threaded end 56 is secured to the tubular member by means of a wing nut 62. The upper connecting rod 46 is adapted to be passed through the channel 22, which is defined by the side rails 14, 16, through the top rung 18 of the ladder 12, and through each of the upper holes in the tubular member 32 so that the threaded end 54 extends perpendicularly from the same. An internally threaded knob 64 secures the threaded end 56 in place.

The lower connecting rod 48 is adapted to be passed through the channel 24, which is defined by the side rails of the ladder and the rung located immediately below the top rung, and through each of the lower holes in the tubular member 32 so that the threaded end 58 extends perpendicularly from the same. An internally threaded knob 66 secures the threaded end 58 in place.

An extension arm 70, which has a first end 72 and a second end 74, is pivotally secured to the top end 34 of the tubular member 30. Similarly, an extension arm 78, which has a first end 80 and a second end 82, is pivotally secured to the top end 38 of the tubular member 32. The extension arms are preferably comprised of aluminum. However, they can be comprised of a variety of different materials. Each of the extension arms is secured to a corresponding tubular member in substantially the same manner. Accordingly, the securement of only one of the extension arms will be described in detail. It being understood that the description applies equally to the other extension arm.

Figure 6:
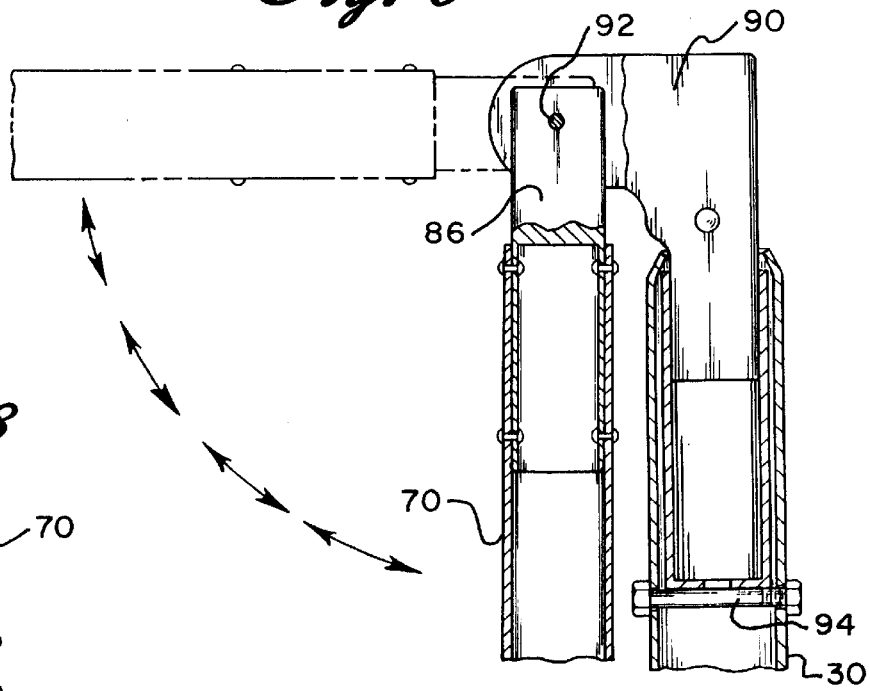
FIG. 6 is a side front elevational view of one of the extension arms showing the rotation of the same about the horizontal plane.
Figure 8:
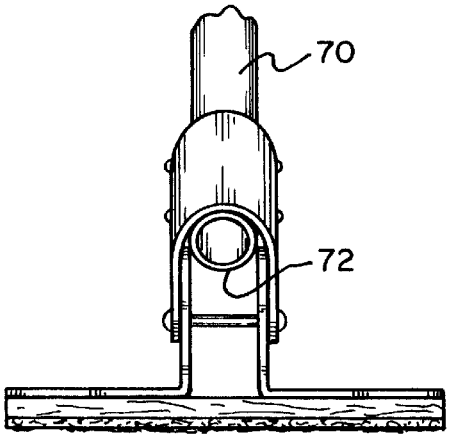
FIG. 8 is a top plan view of a friction pad of one of the extension arms.
Figure 7:
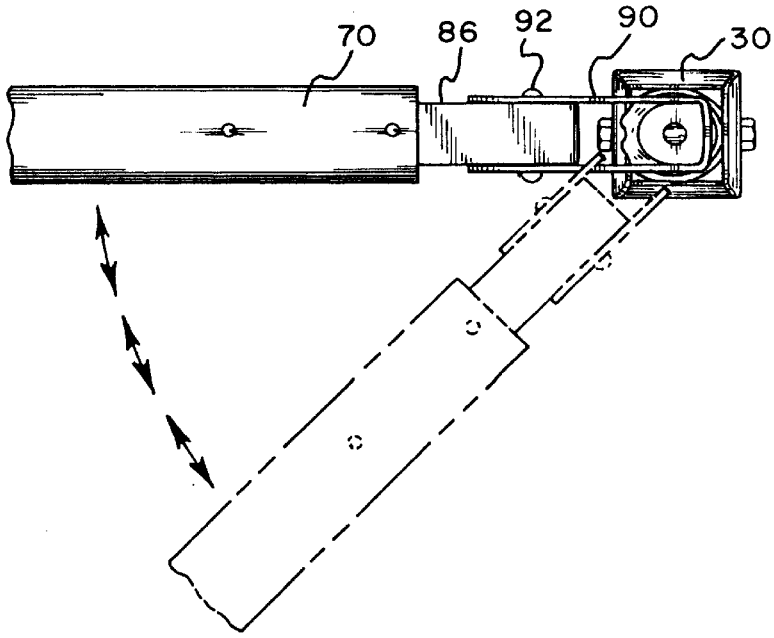
FIG. 7 is a top plan view of one of the extension arms showing the rotation of the same about the vertical plane.

A connecting segment 86 is secured in and extends outwardly from the second end 74 of the extension arm 70 as shown in FIGS. 6 and 7. The free end of the connecting segment 86 is pivotally connected to one end of an L-shaped hinge device 90 by means of a pivot pin 92. The other end of the L-shaped hinge device 90 is mounted for rotation in the tubular member 30 and, more particularly, extends into the top end 34 of the tubular member 30 until it contacts stop pin 94 (FIG. 6). The top end 34 of the tubular member 30 is preferably crimped around the end of the hinge device to secure the same thereto. The hinge device 90 functions as a gimbal to permit movement of the extension arm in three directions.

Figure 1:
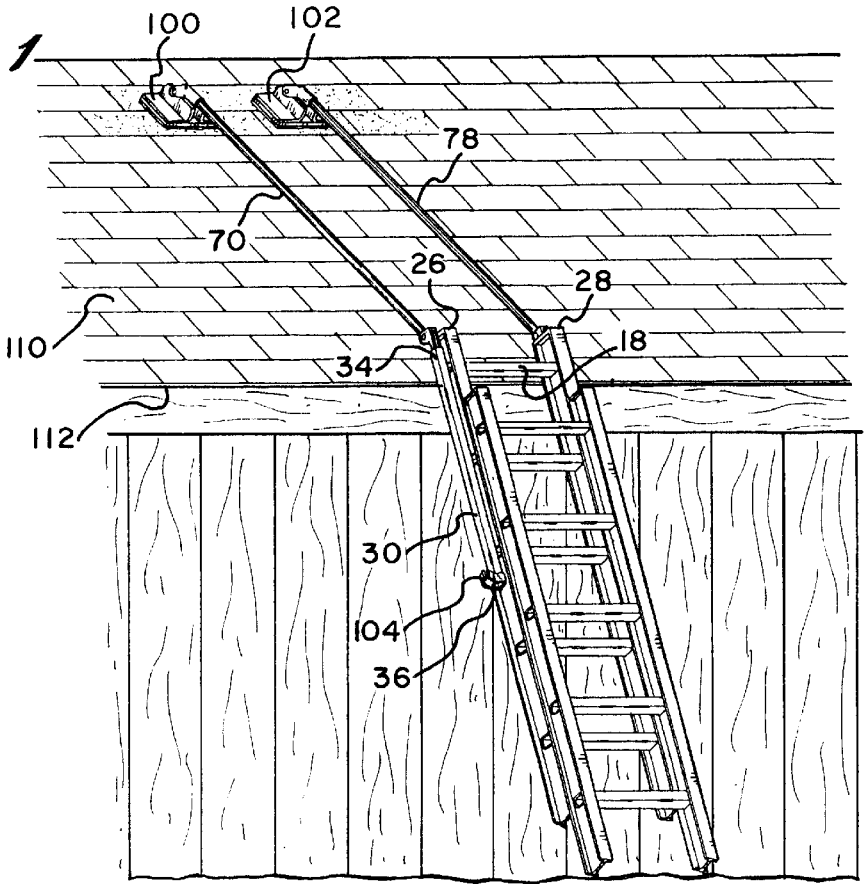
FIG. 1 is a perspective view of the safety ladder attachment shown extending from the top of a ladder and being positioned on a roof.
Figure 2:
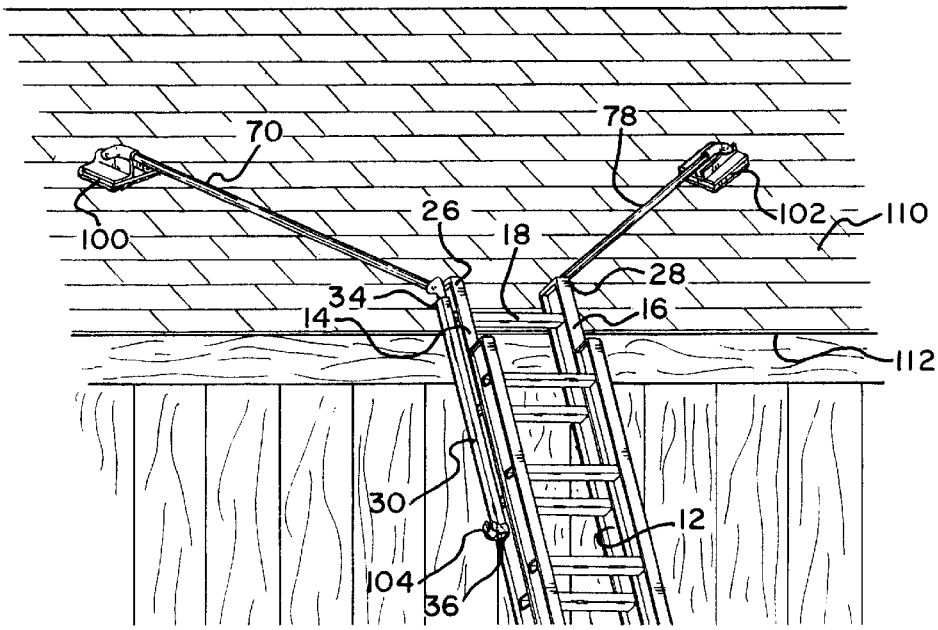
FIG. 2 is a perspective view of the ladder attachment showing each of the extension arms pivotting about a corresponding one of the side rails of the ladder.

The first end 72 of the extension arm 70 has a friction pad 100 pivotally mounted thereto (FIGS. 1–3 and 8). The first end 80 of the extension arm 78 also has a friction pad 102 pivotally mounted thereto (FIGS. 1, 2 and 4).

Figure 3:
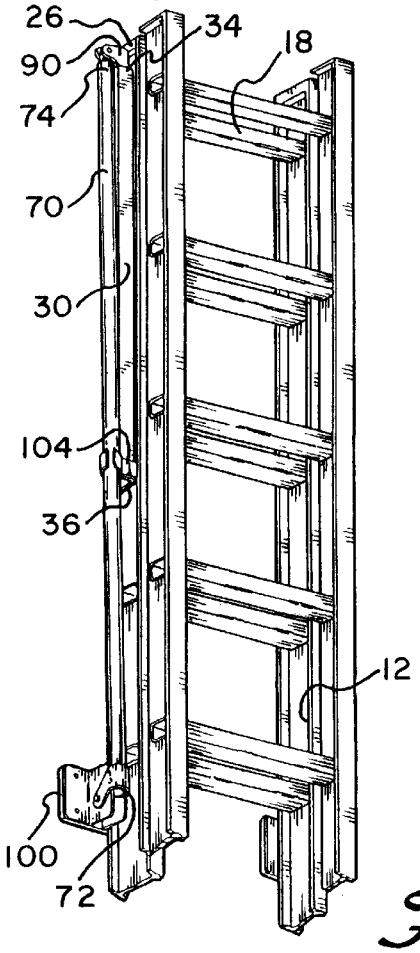
FIG. 3 is a perspective view of one of the extension arms of the ladder attachment in the folded position.
Figure 4:
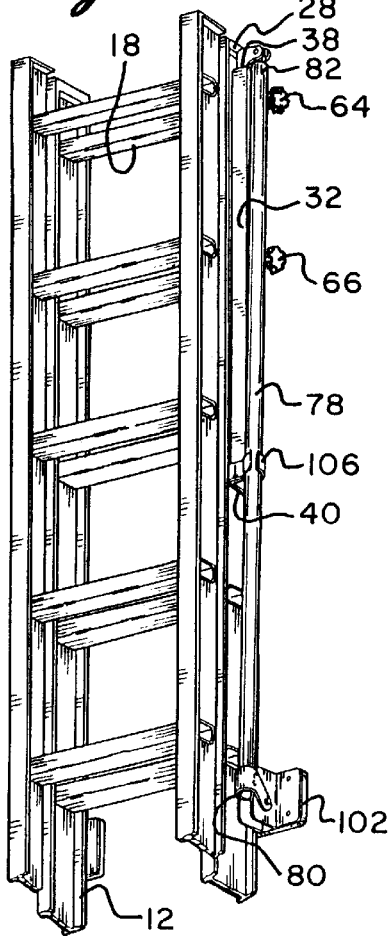
FIG. 4 is a perspective view of the other extension arm in the folded position.

In the preferred embodiment, a clip 104 is secured adjacent the bottom end 36 of the tubular member 30 and a clip 106 is secured adjacent the bottom end 40 of the tubular member 32 (FIGS. 3–5). Each clip is utilized to releasably secure a corresponding one of the extension arms in the inoperable position as more fully described below.

In order to facilitate an understanding of the principles associated with the foregoing apparatus, its operation will now be briefly described. The safety attachment 10 is secured to a ladder 12 in the manner described above. The extension arms are placed in the inoperable position wherein each of the arms is situated adjacent a corresponding one of the tubular members. A worker, who needs to gain access to a roof 110, positions the ladder against a roof edge 112 so that the top rung 18 of the ladder is located adjacent the same (FIGS. 1 and 2).

The worker then climbs up the ladder until he approaches the top of the same. Thereafter, he grabs each of the extension arms and moves them from the inoperable position to an operable position wherein the arms extend outwardly from the upper ends of the side rails of the ladder (FIGS. 1 and 2). The hinge devices allow the extension arms to pivot about two axes when being placed in the operable position.

The friction pads 100 and 102 are placed into contact with the roof 110 to prevent the extension arms from slipping. Further, since the friction pads are pivotally mounted to the extension arms they can completely contact roofs with varying pitches.

Once the extension arms are placed in the operable position, the worker can grab them to assist him while climbing off the ladder and onto the roof. After he is finished working on the roof, he can once again grasp the extension arms to assist him while getting back on the ladder and off the roof. Thereafter, he will once again place the extension arms in the inoperable position.

To keep each of the arms out of the way when not being used, extension arm 70 can be releasably secured adjacent the tubular member 30 by clip 104 and extension arm 78 can be similarly secured adjacent the tubular member 32 by clip 106 (FIGS. 3 and 4).

The present invention may be embodied in other specific forms without departing from the spirit or essential attributes thereof and accordingly reference should be made to the appended claims rather than to the foregoing specification as indicating the scope of the invention.

What is claimed is:

1. A combination of a ladder and a safety attachment for the ladder, the ladder comprising a pair of spaced apart parallel side rails and a plurality of rungs extending between the side rails, said plurality of rungs including a top rung, said side rails having upper free ends, said safety attachment comprising:

a pair of extension arms, each arm including a first end and a second end, said first end of each of said arms having friction pads secured thereto, said second end of each of said arms being hingedly connected to said upper free end of a corresponding one of said side rails so as to permit movement of said extension arms in three directions.

2. The combination of the ladder and the safety attachment of claim 1 wherein each of said extension arms is adapted to move from an operable position, wherein said arms extend outwardly from said upper ends of said side rails of said ladder, to an inoperable position, wherein each of said arms is positioned adjacent a corresponding one of said side rails of said ladder.

3. The combination of the ladder and the safety attachment of claim 1 wherein each of said friction pads is pivotally secured to said first end of said corresponding extension arm.

4. The combination of the ladder and the safety attachment of claim 1 wherein each of said extension arms is adapted to pivot about two axes.

5. A combination of a ladder and a safety attachment for the ladder, the ladder comprising a pair of spaced apart parallel side rails and a plurality of rungs extending between the side rails, said plurality of rungs including a top rung, said side rails having upper free ends, said safety attachment comprising:

a pair of mounting members;

means for securing each of said mounting members to a corresponding side rail of said ladder;

a pair of extension arms, each arm including a first end and a second end, said first end of each of said arms having friction pads secured thereto, said second end of each of said arms being hingedly connected to a corresponding one of said mounting members so as to permit movement of said extension arms in three directions.

6. The combination of the ladder and the safety attachment of claim 5 wherein each of said extension arms is adapted to move from an operable position, wherein said arm extends outwardly from said upper ends of said side rails of said ladder, to an inoperable position, wherein each of said arms is positioned adjacent a corresponding one of said side rails.

7. The combination of the ladder and the safety attachment of claim 5 wherein each of said friction pads is pivotally secured to said first end of said corresponding extension arm.

8. The combination of the ladder and the safety attachment of claim 6 further including means to releasably connect each of said extension arms against said corresponding side rail when said extension arms are positioned in said inoperable position.

9. The combination of the ladder and the safety attachment of claim 5 wherein each of said extension arms is adapted to pivot about two axes.

10. The combination of the ladder and the safety attachment of claim 5 wherein said mounting members are comprised of a pair of tubular members and wherein said means for securing said tubular members to side rails of said ladder includes upper and lower connecting rods, and each of said rungs and said side rails of said ladder defining a channel, each connecting rod having a first end and a second end, said first end of said upper connecting rod being secured to and extending perpendicularly from one of said tubular members so that said upper connecting rod extends through said channel defined by said side rails and through said top rung of said ladder, said second end of said upper connecting rod being secured to the other of said tubular members, said first end of said lower connecting rod being secured to and extending perpendicularly from one of said tubular members so that said lower connecting rod extends through said channel defined by said side rails and through one of said rungs of said ladder located below said top rung, said second end of said lower connecting rod being secured to the other of said tubular members.

* * * * *